United States Patent [19]

Eide

[11] Patent Number: 5,067,661

[45] Date of Patent: Nov. 26, 1991

[54] MILL FOR GRINDING GARBAGE OR THE LIKE

[75] Inventor: Russel L. Eide, Mondovi, Wis.

[73] Assignee: Light Work Inc., New Underwood, S. Dak.

[21] Appl. No.: 377,712

[22] Filed: Jul. 10, 1989

[51] Int. Cl.[5] ..... B02C 13/09

[52] U.S. Cl. ..... 241/55; 241/154; 241/188 R; 241/275; 241/DIG. 38

[58] Field of Search ..... 241/101.7, DIG. 38, 241/188 R, 154, 99, 56, 275, 285 R, 55

[56] References Cited

U.S. PATENT DOCUMENTS

| | | | |
|---|---|---|---|
| 248,923 | 11/1881 | Dechamp | 241/154 |
| 1,212,419 | 1/1917 | Sturtevant | 241/154 |
| 1,758,010 | 5/1930 | Pettinos | 241/154 |
| 2,093,703 | 9/1937 | Blodgett | 241/154 X |
| 2,355,784 | 8/1944 | Dondlinger | 241/56 X |
| 2,700,512 | 1/1955 | Denovan et al. | 241/154 |
| 3,065,919 | 11/1962 | Burkett et al. . | |
| 3,160,354 | 12/1964 | Burkett . | |
| 3,555,996 | 1/1971 | Schwarz et al. . | |
| 3,873,034 | 3/1975 | Iwahori et al. | 241/55 |
| 3,987,970 | 10/1976 | Burkett . | |
| 4,030,670 | 6/1977 | Abernathy . | |
| 4,098,466 | 7/1978 | MacElvain et al. . | |
| 4,144,167 | 3/1979 | Burkett et al. . | |
| 4,151,794 | 5/1979 | Burkett . | |
| 4,493,459 | 1/1985 | Burkett | 241/154 X |
| 4,690,338 | 9/1987 | Sayler et al. | 241/56 |

*Primary Examiner*—Mark Rosenbaum

*Attorney, Agent, or Firm*—Peterson, Wicks, Nemer & Kamrath

[57] ABSTRACT

A mill (10) according to the preferred teachings for grinding garbage is disclosed including an octagonal shaped grinding chamber (26) formed by side plates (14–17) interconnected to have a square cross section with its corners closed by corner plates (20–23). Planar shelves (32, 34, 36) having centrally located apertures (38) divide the grinding chamber (26). Grinding rotors (48–50) are rotatably fixed to a rotatable shaft (44) and are located complementary to, parallel, and above the shelves (32, 34, 36). The grinding rotors (48–50) include planar arms (64) which radially extend from and are circumferentially spaced on a planar disc (54) fixed to the shaft (44). An impeller rotor (51) is also rotatably fixed to the shaft (44) below the grinding rotors (48–50) and includes angle iron arms (76) which radially extend from and are circumferentially spaced on a planar disc (54) fixed to the shaft (44). The arms (64) of the grinding rotors (48–50) may include pusher bars (96) located on top of the arms (64) and within the radial extent of the discs (54) and/or may include flap blades (88) located on the bottom of the arms (64) intermediate the discs (54) and the centrally located apertures (38) of the shelves (32, 34, 36). The radial spacing between the free ends of the arms (64) and the grinding chamber (26) and between the discs (54) and the centrally located apertures (38) and the axial spacing between the grinding rotors (48–50) and the shelves (32, 34, 36) decrease from the grinding rotor (48) adjacent the inlet opening (40) of the grinding chamber (26) to the grinding rotor (50) adjacent the outlet opening (42) of the grinding chamber (26).

19 Claims, 2 Drawing Sheets

MILL FOR GRINDING GARBAGE OR THE LIKE

BACKGROUND

The present invention generally relates to mills for grinding material and particularly to grinding mills for garbage or like material.

A critical problem is the disposal of solid waste which is generated every day in today's society. A common method of solid waste disposal is landfills. However, the volume of landfills is limited and the accessibility to close landfills is becoming more restricted. Thus, a need has arisen to expand the amount of garbage that landfills can accept to extend the life of such landfills.

One method to extend the landfill life is to reduce the compacted volume of the garbage. This is performed by grinding the garbage to reduce the garbage volume by 4 to 1 or more and thereby extending the life of a landfill by that ratio. By composting the ground or processed material, the garbage volume may be further reduced in the order of one half and thereby further extending the life of the landfill. Further, by utilizing high oxygenation of the processed material to invite the growth of aerobic bacteria, the problem of methane gas production existing in current landfills can be reduced and practically eliminated.

Further, many systems for recovering reusable material from garbage or like material requires the garbage to be ground before the garbage is subjected to the various recovery processes.

Thus, a need exists for mills for grinding garbage or like material which is able to grind the garbage to the desired size and to do so efficiently and economically. Such mills should be economical to manufacture and should be able to withstand the forces associated with grinding garbage or encountered when grinding objects which may be found in garbage.

SUMMARY

The present invention solves this need and other problems in grinding garbage or like material by providing, in one aspect, a mill including a plurality of planar grinding rotors which are rotatably fixed to a shaft rotatably mounted in a grinding chamber, with the grinding rotors located parallel to, complementary to, and intermediate the inlet opening of the grinding chamber and a plurality of planar shelves.

In another aspect of the present invention, the mill includes a plurality of grinding rotors rotatably fixed to a shaft rotatably mounted in a grinding chamber, with planar shelves being located in the grinding chamber complementary to the grinding rotors, and further including an impeller rotor rotatably fixed to the shaft and located intermediate the plurality of grinding rotors and the outlet opening for forcing the ground material passing around the grinding rotors out the outlet opening. In the preferred form, the grinding rotors include members for enhancing the creation of a vacuum by the impeller rotor and the movement of light weight ground material through the mill.

In a further aspect of the present invention, the spacing through which the material must pass decreases as the material passes through the grinding rotors of the mill. In a preferred form, the radial spacing of the free ends of the arms of the grinding rotors from the grinding chamber decreases from the grinding rotor adjacent the inlet opening of the grinding chamber to the outlet opening of the grinding chamber. Likewise, in the preferred form, the radial spacing between the planar discs of the grinding rotors from the centrally located apertures of the shelves of the grinding chamber decreases from the grinding rotor adjacent the inlet opening of the grinding chamber to the outlet opening of the grinding chamber.

It is thus an object of the present invention to provide a novel mill for grinding.

It is further an object of the present invention to provide such a novel grinding mill for garbage.

It is further an object of the present invention to provide such a novel grinding mill which may be operated efficiently and economically.

It is further an object of the present invention to provide such a novel grinding mill which is economical to manufacture.

It is further an object of the present invention to provide such a novel grinding mill which is manufactured from stock materials.

It is further an object of the present invention to provide such a novel grinding mill which avoids the use of cast components.

It is further an object of the present invention to provide such a novel grinding mill able to withstand the forces associated with grinding garbage or encountered when grinding objects which may be found in garbage.

It is further an object of the present invention to provide such a novel grinding mill formed by planar rotors formed of planar components which are arranged parallel to planar shelves of a grinding chamber.

It is further an object of the present invention to provide such a novel grinding mill including a propeller type rotor to force the ground material out the outlet opening and to draw the material through the mill.

It is further an object of the present invention to provide such a novel grinding mill including members provided on the grinding rotors for enhancing the vacuum created by the impeller rotor and the movement of the ground material through the mill.

It is further an object of the present invention to provide such a novel grinding mill having decreasing spacing through which the ground material must pass through the grinding rotors of the mill.

It is further an object of the present invention to provide such a novel grinding mill having a dust control system.

It is further an object of the present invention to provide such a novel grinding mill having a composting bacteria inoculation system.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
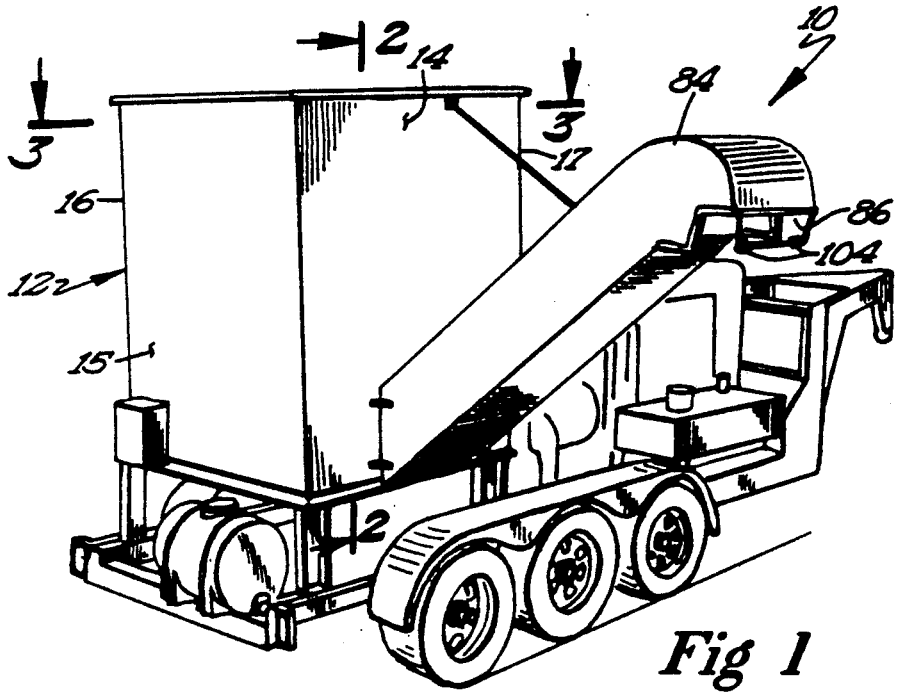
FIG. 1 shows a perspective view of a garbage grinding mill according to the preferred teachings of the present invention.
Figure 2:
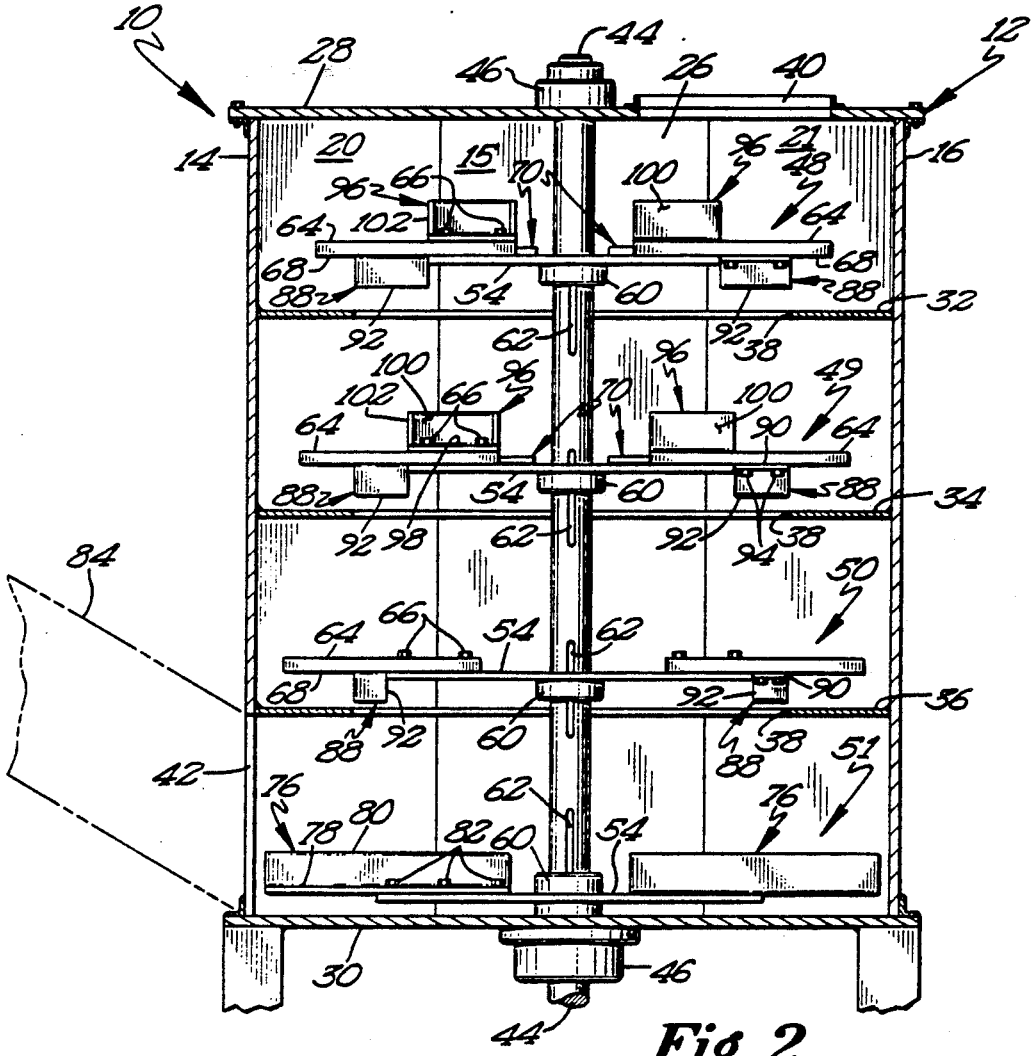
FIG. 2 shows a partial, cross sectional view of the garbage grinding mill of FIG. 1 according to section line 2—2 of FIG. 1.
Figure 3:
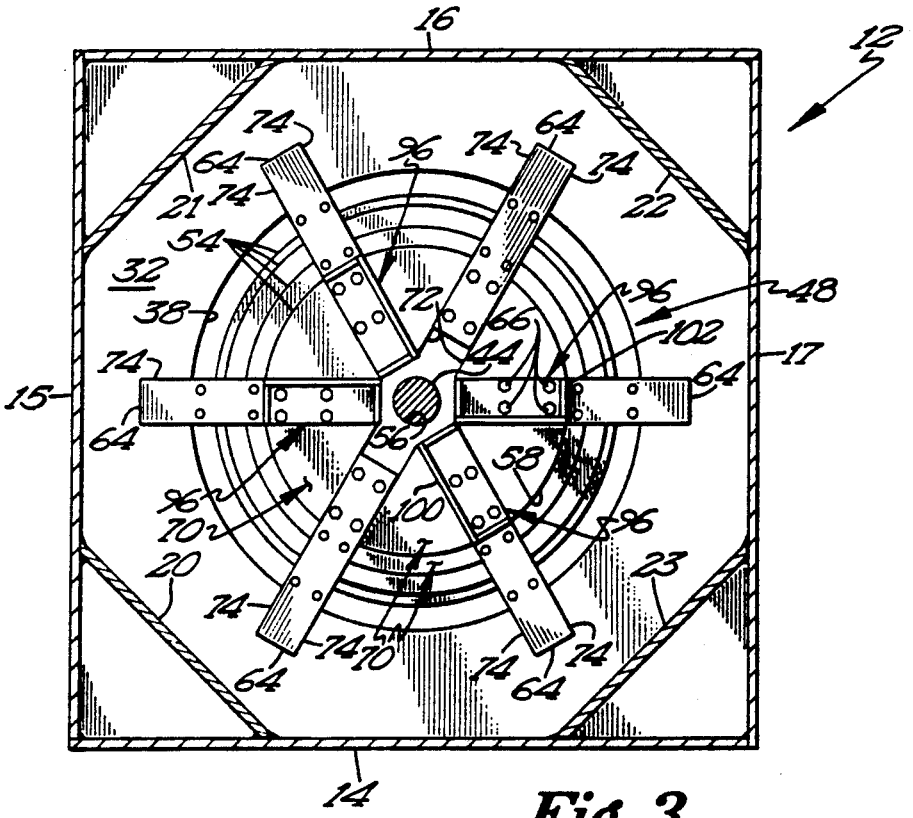
FIG. 3 shows a cross sectional view of the garbage grinding mill of FIG. 1 according to section line 3—3 of FIG. 1.
Figure 4:
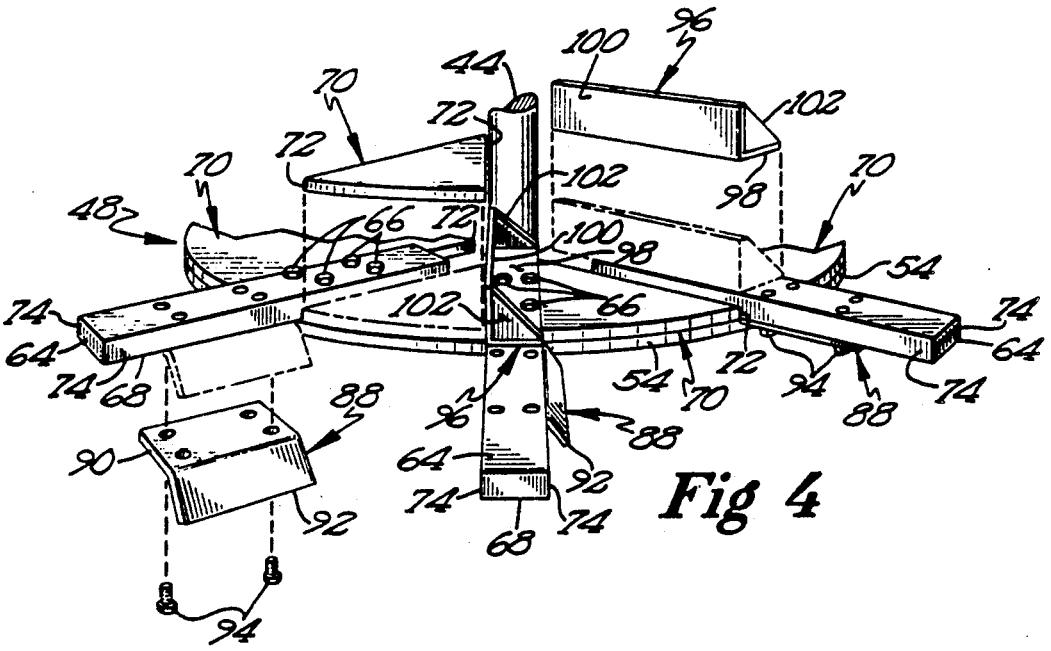
FIG. 4 shows a partial, exploded view of the garbage grinding mill of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "upper", "lower", "vertical", "horizontal", "rearward", "ends", "side", "edge", and similar terms are used herein, it should be understood that these terms have reference only to the structure shown in the drawings as it would appear to a person viewing the drawings and are utilized only to facilitate describing the invention.

DESCRIPTION

A mill according to the most preferred teachings of the present invention for processing, resizing, or grinding solid waste, sorted recycled materials such as glass, tin, plastic, aluminium, or paper products, garbage, or like material is shown in the drawings and generally designated 10. In the most preferred form of mill 10 shown in FIG. 1, mill 10 is shown mounted on a trailer for portability. It can be appreciated that mill 10 according to the teachings of the present invention can be constructed for permanent installation. Mill 10 includes a housing 12 which is generally cylindrical in configuration. In the most preferred form, housing 12 includes four flat or planar, generally rectangular side plates 14, 15, 16, and 17 which are interconnected together by their side edges to have a square cross section. Housing 12 further includes four flat or planar, generally rectangular plates 20, 21, 22, and 23 which are interconnected by their side edges to adjacent side plates 14, 15, 16, and 17 at 45° angles. Plates 14–17 and 20–23 define a grinding chamber 26 having an octagonal cross section, and in the most preferred form the sides of the octagonal cross section have equal lengths and have equal angles therebetween. Housing 12 further includes a top plate 28 and bottom plate 30 attached to the upper and lower ends of plates 14–17 and 20–23.

Chamber 26 of housing 12 is divided into sections by horizontal shelves 32, 34, and 36 secured in chamber 26. Specifically, each of shelves 32, 34, and 36 have an octagonal periphery complementary to and for attachment to the octagonal sides of chamber 26. Each of shelves 32, 34, and 36 further include centrally located apertures 38. Apertures 38 of shelves 32, 34, and 36 in the most preferred form are of the same size. An inlet opening 40 to chamber 26 is formed in top plate 28. An outlet opening 42 from chamber 26 is formed in plate 14 intermediate plates 20 and 23 and below shelf 36.

It can then be appreciated that housing 12 is believed to be particularly advantageous. For example, housing 12 is of a strong design, with plates 20–23 acting as braces between plates 14–17. Further, shelves 32, 34 and 36 are of identical construction to reduce manufacturing set-up and inventory. Furthermore, housing 12 can be easily and rapidly manufactured and assembled with less tolerances than required to manufacture and assemble an octagonal housing as an example.

Mill 10 further includes a shaft 44 rotatably mounted in chamber 26 concentrically within apertures 38 of shelves 32, 34, and 36. In the most preferred form, shaft 44 is rotatably mounted by bearings 46 located in top and bottom plates 28 and 30. Shaft 44 may be driven in any suitable manner. For example, in the most preferred form, shaft 44 extends from chamber 26 beyond bottom plate 30 and includes a suitable drive connection such as a V-belt pulley which in turn can be driven by any suitable means such as an electric motor or an internal combustion engine.

Mill 10 further includes rotors 48, 49, 50, and 51 rotatably fixed to shaft 44 and located complementary to and intermediate opening 40 of chamber 26 and shelves 32, 34 and 36 and bottom plate 30 and in the most preferred form are located above shelves 32, 34, and 36 and bottom plate 30 respectively. Rotors 48–51 each include a circular, flat or planar disc 54 having a central opening 56 and a circular periphery 58. A hub 60 which is longitudinally adjustable but rotatably fixed on shaft 44 along a keyway 62 is located within and attached to opening 56 of disc 54. Discs 54 of rotors 48–50 have a size less than the size of apertures 38 of shelves 32, 34, and 36 and which increases from rotor 48 to rotor 50, with disc 54 of rotor 48 being smaller than disc 54 of rotor 49 and with disc 54 of rotor 49 being smaller than disc 54 of rotor 50.

Rotors 48–50 are in the form of grinding rotors and further include a multiplicity of arms 64 dynamically mounted on and extending radially from discs 54 and circumferentially spaced from each other. Arms 64 are elongated and flat or planar and have a generally rectangular cross section. In the most preferred form, arms 64 are of the same length in rotors 48–50 but are attached to discs 54 such that the radial extent of the free ends of arms 64 from shaft 44 increase from rotors 48 to rotor 50 with the free ends of arms 64 of rotor 48 extending from shaft 44 a radial distance less than the free ends of arms 64 of rotor 49 and with the free ends of arms 64 of rotor 49 extending from shaft 44 a radial distance less than the free ends of arms 64 of rotor 50. In the most preferred form, arms 64 are horizontal and attached to discs 54 by bolts 66 extending through arms 64 and discs 54, with the first or bottom surface 68 of arms 64 abutting directly with the top surface of discs 54.

Bracing structures 70 are further provided in rotors 48 and 49 intermediate arms 64. Specifically, structures 70 are wedge shaped having a thickness which in the preferred form is less than the thickness of arms 64. The bottom surfaces of wedge shaped bracing structures 70 abut directly with the top surfaces of discs 54 and are secured thereto such as by welding and plug welding. The side edges 72 of structures 70 abut directly with the side edges 74 of adjacent arms 64. Arms 64 are then located in a trough formed by adjacent bracing structures 70. It can then be appreciated that discs 54 and bracing structures 70 provide abutment and force transferring support for arms 64, with bolts 66 accepting force on arms 64 in a direction out of the trough formed by adjacent bracing structures 70. Thus, the amount and direction of force to which bolts 66 are subjected in operation are greatly restricted according to the teachings of the present invention. In the most preferred form, disc 54 of rotor 48 may have a greater thickness than discs 54 of rotors 49–51 for increased strength.

Rotors 48–50 are positioned upon shaft 44 above and parallel to shelves 32, 34, and 36, with the vertical or axial spacing of rotors 48–50 above shelves 32, 34, and 36 decreasing from rotor 48 to rotor 50, with the vertical spacing between rotor 48 and shelf 32 being greater than the vertical spacing between rotor 49 and shelf 34 and with the vertical spacing between rotor 49 and shelf 34 being greater than the vertical spacing between rotor 50 and shelf 36. Arms 64 of rotors 48–50 extend radially past apertures 38 and over shelves 32, 34, and 36, with the radial extent which arms 64 extend onto shelves 32, 34, and 36 increasing or in other words the radial spacing of the free ends of arms 64 from chamber 26 decreasing due to the increasing radial extend of the free ends of arms 64 from shaft 44 of rotors 48–50 respectively. Discs 54 of rotors 48–50 are located radially within apertures 38 of shelves 32, 34, and 36, with the radial spacing between discs 54 and apertures 38 decreasing from rotor 48 and shelf 32 to rotor 50 and shelf 36 due to the increasing size of discs 54 of rotors 48–50.

Rotor 51 is in the form of a propeller or an impeller located intermediate the plurality of grinding rotors 48–50 and outlet opening 42 for forcing ground material from grinding rotors 48–50 out of outlet opening 42. In the preferred form, impeller rotor 51 includes a multiplicity of arms 76 dynamically mounted and radially extending from disc 54 and circumferentially spaced from each other. In the most preferred form, arms 76 are formed from angle iron and specifically include a first side 78 and a second side 80. The first end of side 78 abuts directly with the top surface of disc 54 and attached thereto such as by bolts 82 extending through side 78 and disc 54. Side 80 upstands generally perpendicular from disc 54.

Mill 10 further includes a chute 84 extending from outlet opening 42 of chamber 26 to a chute opening 86.

Now that the basic construction of mill 10 according to the preferred teachings of the present invention has been explained, the operation, further enhancements, and subtle features of the present invention can be set forth and appreciated. Specifically, shaft 44 and rotors 48–51 rotatably fixed thereto are rotated. Garbage can then can be introduced through inlet opening 40 by any suitable means such as by a conveyor, not shown. Upon entry into chamber 26, the garbage is impinged by arms 64 of rotor 48 which then breaks or grinds the garbage. It can then be appreciated that to pass rotor 48 and shelf 32, the garbage must pass between arms 64 of rotor 48 which are rotating thus greatly restricting passage therethrough and/or must pass between the free ends of arms 64 of rotor 48 and plates 14–17 and 20–23 defining the walls of chamber 26 and between arms 64 of rotor 48 and shelf 32 and through aperture 38 of shelf 32. It can then be appreciated that the garbage must have been reduced to a physical size before passage is allowed as set forth.

When the garbage passes through aperture 38 of shelf 32, the garbage is impinged by arms 64 of rotor 49 which then further breaks or grinds the garbage. It can then be appreciated that to pass rotor 49 and shelf 34, the garbage must pass between arms 64 of rotor 49 which are rotating thus greatly restricting passage therethrough and/or must pass between the free ends of arms 64 of rotor 49 and plates 14–17 and 20–23 defining the walls of chamber 26 and between arms 64 of rotor 49 and shelf 34 and through aperture 38 of shelf 34. It can then be appreciated that the garbage must have been reduced to a physical size before passage is allowed as set forth. It should be further appreciated that due to the decreasing radial spacing between the free ends of arms 64 of rotor 49 and chamber 26, the decreasing vertical spacing between rotor 49 and shelf 34, and the decreasing radial spacing between disc 54 of rotor 49 and aperture 38 of shelf 34 than the corresponding spacings of rotor 48 and shelf 32, the physical size of the ground garbage passing through aperture 38 of shelf 34 is generally smaller than the physical size of the ground garbage passing through aperture 38 of shelf 32.

When the garbage passes through aperture 38 of shelf 34, the garbage is impinged by arms 64 of rotor 50 which then further breaks or grinds the garbage. It can then be appreciated that to pass rotor 50 and shelf 36, the garbage must pass between arms 64 of rotor 50 which are rotating thus greatly restricting passage therethrough and/or must pass between the free ends of arms 64 of rotor 50 and plates 14–17 and 20–23 defining the walls of chamber 26 and between arms 64 of rotor 50 and shelf 36 and through aperture 38 of shelf 36. It can then be appreciated that the garbage must have been reduced to a physical size before passage is allowed as set forth. It should be further appreciated that due to the decreasing radial spacing between the free ends of arms 64 of rotor 50 and chamber 26, the decreasing vertical spacing between rotor 50 and shelf 36, and the decreasing radial spacing between disc 54 of rotor 50 and aperture 38 of shelf 36 than the corresponding spacings of rotor 49 and shelf 34, the physical size of the ground garbage passing through aperture 38 of shelf 36 is generally smaller than the physical size of the ground garbage passing through aperture 38 of shelf 34.

When garbage passes through aperture 38 of shelf 36, rotor 51 acts as an impeller blowing or forcing the garbage through outlet opening 42 of chamber 26, through chute 84, and out of chute opening 86. It can further be appreciated that rotor 51 acting as an impeller creates a vacuum inside of chamber 26 which acts to suck the garbage from above rotor 51 and around and between rotors 48–50 and shelves 32, 34, and 36.

As a large percentage of garbage is paper or other light weight products such as from packaging, there may exist a tendency for particles when ground from such paper or other light weight products to float above the rotating grinding members. The vacuum created by impeller rotor 51 sucks these light weight particles around and between rotors 48–50 and shelves 32, 34, and 36 and through mill 10 out of chute 84. To enhance the creation of a vacuum and the movement of light weight particles through mill 10, mill 10 according to the preferred teachings of the present invention further includes flaps 88 secured axially intermediate arms 64 and shelves 32, 34, and 36 and radially intermediate discs 54 and aperture 38 of shelves 32, 34 and 36 and particularly in the preferred form to bottom surface 68 of arms 64 of grinding rotors 48–50. In the most preferred form, flaps 88 are formed by an angled member including first and second flat portions 90 and 92 which are interconnected together by an obtuse angle in the order of 150°. Flat portion 90 of flaps 88 abuts directly with bottom surface 68 of arm 64 and is attached thereto such as by bolts 94. Flat portion 92 extends downwardly and rearwardly from portion 90 in a direction opposite to the direction of rotation of arms 64 and rotors 48–50. Thus, upon rotation of rotors 48–50, flaps 88 further create a downward movement of air through chamber 26. The number and location of flaps 88 provided in mill 10 can then be varied according to the actual vacuum created by rotor 51, the type 5 of material which is to be ground, and like factors. It can be appreciated that too much vacuum is undesirable as the material may be pulled through mill 10 before being ground to the desired size. For example, flaps 88 may be provided only on selected arms 64 rather than on all arms 64 of a particular rotor 48–50, with flaps 88 being provided on diametrically opposite arms 64 in rotors 48–50. Likewise, flaps 88 may be omitted from rotor 48 to reduce the impingement area as rotor 48 initially impinge the incoming garbage, and the like.

As generally arms 64 must impinge the garbage for a grinding action to occur and as generally the bulk of the ground material must pass around the free ends of rotors 48–50, mill 10 further includes pusher bars 96 secured to the top surface of arms 64 of rotors 48 and 49 radially inside of discs 54. In the most preferred form, bars 96 are formed of angle iron including first and second flat portions 98 and 100 attached generally perpendicular thereto and triangular end braces 102 attached to the opposite ends for providing additional support for portion 100. Flat portion 98 of bars 96 abuts directly with the top surface of arm 64 and is attached thereto such as by bolts 66 which secure arms 64 to discs 54. Flat portion 100 extends generally perpendicular from the top surface of arm 64. Pusher bars 96 push any material which may have a tendency to collect around shaft 44 and on top of disc 54 radially outwardly to where the grinding action occurs. It should be noted that unground garbage entering chamber 26 through opening 40 may directly engage bars 96 of rotor 48 and/or relatively large sized material only partially ground may engage bars 96 of rotors 48 and 49, bars 96 should have the necessary strength to allow continued operation without fatigue or failure, with end braces 102 enhancing this strength and part longevity. The number and location of pusher bars 96 provided in mill 10 can then be varied according to the type of material which is to be ground and like factors. For example, pusher bars 96 may be provided only on selected arms 64 rather than on all arms 4 of rotors 48 and 49, with pusher bars 96 being on diametrically opposite arms 64 in rotors 48–50. Likewise, due to the generally ground nature of the material reaching rotor 50 and the proximity to impeller rotor 51 and the vacuum created thereby, pusher bars 96 have been omitted from rotor 50 in the preferred form.

Mill 10 further includes provisions for controlling dust from the ground material exiting opening 86 of chute 84 under the windage created by impeller rotor 51. In the most preferred form, first and second nozzles 104 which are suspended from chute 84 below opening 86 and generally outside of the path of material exiting from opening 86. Nozzles 104 spray a flat, wide angle of water into the path of material exiting from opening 86 to wet down the material. The water can be supplied to nozzles 104 by pipe water pressure or by an electric pump. If the ground material is going to be composted, nozzles 104 may further inoculate the ground material with a composting bacteria to reduce the time necessary for composting.

In the most preferred form, disc 54 of rotor 49 and shelf 32, disc 54 of rotor 50 and shelf 34, and disc 54 of rotor 51 and shelf 36 are each cut from a single piece of flat material to maximize material useage. Further, disc 54 of rotor 48 in the preferred form is formed of thicker material than discs 54 of rotors 49–51 for increased strength to initially engage and grind the garbage entering chamber 26.

Mill 10 according to the teachings of the present invention is able to effectively and efficiently grind garbage. Particularly, mill 10 utilizes the sharp edges of ground materials such as glass, metal, and hard plastic found in containers, cans, and the like moving inside of chamber 26 and hitting each other and other material to increase the grinding action of rotors 48–50 of mill 10.

It is further believed that the construction of mill 10 according to the preferred teachings of the present invention is particularly advantageous. For example, rotors 48–50 and housing 12 are formed from stock materials which are easily obtainable at low cost and specifically avoid the high capital cost required for special cast components. Additionally, the components of rotors 48–51 directly abut each other without wedge shaped members and the like located intermediate thereto. Thus, the amount of stress placed upon bolts 66 and 94 is reduced and can be more easily controlled.

Now that the basic teachings of the present invention have been explained, many extensions and variations may be obvious to one having ordinary skill in the art. For example, a dust separator can be provided at the output end of mill 10 in addition to or alternately to nozzles 104 of the most preferred form.

Although the preferred teachings of the present invention has been explained for grinding garbage and mill 10 is believed to be particularly advantageous therefor, mill 10 may be utilized for grinding like material. For example, mill 10 may be utilized for grinding tires and teeth may be provided on arms 64 and/or in chamber 26 to aid in cutting rubber.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Mill for processing material such as garbage comprising, in combination: a housing defining a grinding chamber having an inlet opening and an outlet opening; a plurality of substantially planar shelves secured in the housing and dividing the grinding chamber into sections, with each of the planar shelves including a centrally located aperture having a size; a shaft rotatably mounted in the grinding chamber and concentrically within the centrally located apertures of the planar shelves; a plurality of grinding rotors rotatably fixed to the shaft and located complementary to and intermediate the inlet opening and the plurality of planar shelves, with each of the rotors comprising a planar disc of a size smaller than the centrally located aperture of the planar shelf and a plurality of planar arms rotationally fixed to and extending radially from the planar disc and circumferentially spaced from each other, with the radial extent of the planar arms extending past the centrally located apertures of the planar shelf and over the planar shelf so that the material passing beyond the radial extent of the planar arms passes between the radial extent of the planar arms and the housing and between the planar arms and the planar shelves before passing through the centrally located apertures of the planar shelves, with the planar disc and planar arms being parallel to the planar shelf; an impeller rotor rotatably fixed to the shaft and located intermediate the plurality of grinding rotors and the outlet opening, with the impeller rotor creating a windage for blowing the ground material from the grinding rotors out the outlet opening; and means on the grinding rotors for creating a downward movement of air towards the impeller rotor for enhancing the creation of a vacuum by the impeller rotor and the movement of light weight ground material around and between the arms of the grinder rotors and through the centrally located apertures of the shelves through the mill.

2. The mill of claim 1 wherein the creating means comprises flap blades secured to the grinding rotors radially within the centrally located aperture of the planar shelf.

3. The mill of claim 2 wherein the grinding rotor is horizontal and includes a bottom surface; and wherein the flaps comprise an angled member including first and second flat portions which are interconnected together at an obtuse angle, with the first flat portion directly abutting and being secured to the bottom surface of the grinding rotor and with the second flat portion extending downwardly and rearwardly from the first flat portion in a direction opposite to the direction of rotation of the grinding rotor.

4. The mill of claim 1 further comprising, in combination: a chute extending from the outlet opening of the grinding chamber and including a chute opening; and means suspended from the chute for controlling dust from the ground material and adapted to allow inoculation of the ground material with composting bacteria comprising nozzles for spraying the ground material exiting from the chute opening.

5. Mill for processing material such as garbage comprising, in combination: a housing defining a grinding chamber having an inlet opening and an outlet opening; a plurality of substantially planar shelves secured in the housing and dividing the grinding chamber into sections, with each of the planar shelves including a centrally located aperture having a size; a shaft rotatably mounted in the grinding chamber and concentrically within the centrally located apertures of the planar shelves; a plurality of grinding rotors rotatably fixed to the shaft and located complementary to and intermediate the inlet opening and the plurality of planar shelves, with each of the rotors comprising a planar disc of a size smaller than the centrally located aperture of the planar shelf and a plurality of planar arms rotationally fixed to and extending radially from the planar disc and circumferentially spaced from each other, with the radial extent of the planar arms extending past the centrally located apertures of the planar shelf and over the planar shelf so that the material passing beyond the radial extent of the planar arms passes between the radial extent of the planar arms and the housing and between the planar arms and the planar shelves before passing through the centrally located apertures of the planar shelves, with the planar disc and planar arms being parallel to the planar shelf; wherein the arms of the grinding rotors have free ends; and wherein the radial spacing of the free ends of the arms of the grinding rotors from the grinding chamber decrease from the grinding rotor adjacent to the inlet opening to the grinding rotor adjacent the outlet opening.

6. The mill of claim 5 further comprising, in combination: an impeller rotor rotatably fixed to the shaft and located intermediate the plurality of grinding rotors and the outlet opening, with the impeller rotor creating a windage for blowing the ground material from the grinding rotors out the outlet opening.

7. The mill of claim 1 wherein the impeller rotor comprises, in combination: a planar, impeller disc rotatably fixed to the shaft; and a plurality of impeller arms extending radially from the planar impeller disc and circumferentially spaced from each other, with the impeller arms formed of an angle iron including a first side and a second side extending perpendicularly from the first side, with the first side abutting directly and attached to the planar, impeller disc.

8. The mill of claim 5 wherein the arms of the grinding rotors have equal length for ease of manufacture and inventory, with the radial extent of the arms of the grinding rotors being varied for the grinding rotors of the mill by varying the securement to the planar disc.

9. The mill of claim 5 wherein the radial spacing between the planar disc and the centrally located aperture of the planar shelf decreases from the grinding rotor adjacent to the inlet opening to the grinding rotor adjacent the outlet opening.

10. The mill of claim 9 wherein the centrally located apertures of the planar shelves are of equal size; and wherein the size of the planar discs of the grinding rotors increases from the grinding rotor adjacent to the inlet opening to the grinding rotor adjacent the outlet opening.

11. The mill of claim 9 wherein the axial spacing between the grinding rotors and the planar shelves decreases from the grinding rotor adjacent to the inlet opening to the grinding rotor adjacent the outlet opening.

12. Mill for processing material such as garbage comprising, in combination: a grinding chamber having an inlet opening and an outlet opening; a plurality of planar shelves secured in the grinding chamber and dividing the grinding chamber into sections, with each of the planar shelves including a centrally located aperture having a size; a shaft rotatably mounted in the grinding chamber and concentrically within the centrally located apertures of the planar shelves; a plurality of grinding rotors rotatably fixed to the shaft and located complementary to and intermediate the inlet opening and the plurality of planar shelves, with each of the rotors comprising a planar disc of a size smaller than the centrally located aperture of the planar shelf and a plurality of planar arms extending radially from the planar disc and circumferentially spaced from each other, with the planar disc and planar arm being parallel to the planar shelf; and means on the grinding rotors for pushing the material radially outwardly of the planar disc of the grinding rotors.

13. The mill of claim 12 wherein the pushing means comprises pusher bars comprising, in combination: first and second flat portions attached generally perpendicular to each other and having opposite ends; and triangular end braces extending between the first and second flat portions and located on the ends of the first and second flat portions, with the first flat portion being secured to the arms of the grinding rotor radially within the planar disc of the grinding rotor and with the planar arm being axially intermediate the first flat portion and the planar disc.

14. Mill for grinding material such as garbage comprising, in combination: a grinding chamber having an inlet opening and an outlet opening; a plurality of horizontal shelves secured in the grinding chamber and dividing the grinding chamber into sections, with each of the shelves including a centrally located aperture having a size; a vertical shaft rotatably mounted in the grinding chamber and concentrically within the centrally located apertures of the shelves; a plurality of grinding rotors rotably fixed to the shaft and located completely to the plurality of shelves, and means located on the grinding rotors radially within the centrally located apertures of the shelves for creating a downward movement of air for enhancing the movement of light weight ground material past the grinding rotor and through the centrally located aperture of the shelf through the mill.

15. The mill of claim 14 further comprising, in combination: an impeller rotor rotatably fixed to the shaft and located intermediate the plurality of grinding rotors and the outlet opening, with the impeller rotor creating a windage for blowing the ground material from the grinding rotors out the outlet opening, with the creating means enhancing the creation of a vacuum by the impeller rotor.

16. The mill of claim 15 wherein the grinding rotor includes a first surface; and wherein the enhancing means comprises flaps secured to the grinding rotor, with the flaps comprising an angled member including first and second flat portions which are interconnected together at an obtuse angle, with the first flat portion directly abutting and being secured to the first flat surface of the grinding rotor and with the second flat portion extending downwardly and rearwardly from the first flat portion in a direction opposite to the direction of rotation of the grinding rotor.

17. Mill for grinding material such as garbage comprising, in combination: a grinding chamber having an inlet opening and an outlet opening; a plurality of shelves secured in the grinding chamber and dividing the grinding chamber into sections, with each of the shelves including a centrally located aperture having a size; a shaft rotatably mounted in the grinding chamber and concentrically within the centrally located apertures of the shelves; and a plurality of grinding rotors rotatably fixed to the shaft and located complementary to and intermediate the inlet opening and the plurality of shelves, with each of the rotors comprising a disc of a size smaller than the centrally located aperture of the shelf and a plurality of arms extending radially from the disc and circumferentially spaced from each other, with the radial extent of the planar arms extending past the centrally located apertures of the planar shelf and over the shelf, with the arms of the grinding rotors having free ends; the shelf decreases from the grinding rotor adjacent to the inlet opening to the grinding rotor adjacent the outlet opening.

18. The mill of claim 17 further comprising, in combination: a housing defining the grinding chamber; wherein the radial spaceing of the free ends of the arms of the grinding rotors from the housing decreases from the grinding rotor adjacent to the inlet opening to the grinding rotor adjacent the outlet opening.

19. The mill of claim 17 wherein the centrally located apertures of the shelves are of equal size; and wherein the size of the discs of the grinding rotors increases from the grinding rotor adjacent to the inlet opening to the grinding rotor adjacent the outlet opening.

* * * * *

UNITED STATES PATENT AND TRADEMARK OFFICE

CERTIFICATE OF CORRECTION

PATENT NO. : 5,067,661

DATED : November 26, 1991

INVENTOR(S) : Russel L. Eide

It is certified that error appears in the above-identified patent and that said Letters Patent is hereby corrected as shown below:

Title Page, cancel the inventor's address of "Mondovi, Wis." and substitute therefor --Columbia Heights, Mn.--.

Cover Page, after "3,160,354 12/1964 Burkett" insert --3,490,704 1/1970 Bourne et al. ..... 241/154--.

Cover Page, after "4,690,338 9/1987 Sayler et al. ..... 241/56" insert --FOREIGN PATENT DOCUMENTS
1126320 11/1984 U.S.S.R. ..... 241/154--.

Column 3, line 1 should not be indented.

Column 7, line 4, cancel "5".

Column 7, line 44, cancel "4" and substitute therefor --64--.

Column 9, line 47, after "shelves;" insert --and--.

Column 11, line 33, cancel "flat".

Column 12, line 19, cancel "planar".

UNITED STATES PATENT AND TRADEMARK OFFICE

CERTIFICATE OF CORRECTION

PATENT NO. : 5,067,661

DATED : November 26, 1991

INVENTOR(S) : Russel L. Eide

It is certified that error appears in the above-identified patent and that said Letters Patent is hereby corrected as shown below:

Column 12, line 21, after "ends;" insert --wherein the radial spacing between the disc and the centrally located aperture of--.

Signed and Sealed this

Sixteenth Day of March, 1993

*Attest:*

STEPHEN G. KUNIN

*Attesting Officer*

*Acting Commissioner of Patents and Trademarks*